United States Patent [19]

Kallioinen et al.

[11] Patent Number: 5,039,400

[45] Date of Patent: Aug. 13, 1991

[54] FLOTATION MACHINE

[75] Inventors: Jouko O. Kallioinen, Espoo; Pertti V. O. Koivistoinen, Pyhäkumpu; Seppo O. Rantanen, Outokumpu, all of Finland

[73] Assignee: Outokumpu Oy, Helsinki, Finland

[21] Appl. No.: 488,512

[22] Filed: Feb. 27, 1990

Related U.S. Application Data

[63] Continuation of Ser. No. 254,427, Oct. 6, 1988, abandoned.

[30] Foreign Application Priority Data

Oct. 7, 1987 [FI] Finland ..... 874415

[51] Int. Cl.[5] ..... B03D 1/14; B03D 1/16

[52] U.S. Cl. ..... 209/164; 209/168; 209/169; 261/87

[58] Field of Search ..... 209/164, 168, 169, 170; 210/219, 221.2, 221.1; 261/87, 93

[56] References Cited

U.S. PATENT DOCUMENTS

| | | | |
|---|---|---|---|
| 1,952,727 | 3/1934 | Ralston | 209/170 |
| 2,061,564 | 11/1936 | Drake | 209/169 |
| 2,182,442 | 12/1939 | Booth | 209/169 |
| 2,369,401 | 2/1945 | Morash | 209/169 |
| 2,756,877 | 7/1956 | Sayers | 209/169 |
| 3,032,199 | 5/1962 | Sumiya | 209/170 |
| 3,339,730 | 9/1967 | Boutin | 209/170 |
| 3,371,779 | 3/1968 | Hollingsworth | 209/170 |
| 4,668,382 | 5/1987 | Jameson | 210/221.2 |
| 4,750,994 | 6/1988 | Schneider | 209/169 |
| 4,804,460 | 2/1989 | Moys | 209/164 |

FOREIGN PATENT DOCUMENTS

| | | | |
|---|---|---|---|
| 146235 | 6/1985 | European Pat. Off. | 209/169 |
| 211494 | 7/1984 | German Democratic Rep. | 209/169 |

*Primary Examiner*—Stanley S. Silverman
*Assistant Examiner*—Thomas M. Lithgow
*Attorney, Agent, or Firm*—Dellett, Smith-Hill and Bedell

[57] ABSTRACT

The invention relates to a flotation machine for flotating minerals and the like from slurries containing these particles. In the flotation machine of the invention, above the feed opening (15) of the flotation cell there is formed a froth bed (11) which is adjustable in volume and/or surface area. The regulating and washing members (10, 13) of the froth bed are arranged within the froth bed (11), and the height of the froth bed is 20–40%, advantageously 30–35% of the height of the flotation cell (1).

15 Claims, 2 Drawing Sheets

FLOTATION MACHINE

This is a continuation of co-pending application Ser. No. 07/254,427 filed Oct. 6, 1988, now abandoned.

The present invention relates to a flotation machine for flotating minerals or the like from slurries containing these particles. The flotation machine is composed of a flotation cell and a mixing device placed in the cell, which device comprises a stator-rotor combination provided with actuator and air supply means.

Any material to be treated by flotation is generally subjected to conditioning prior to the flotation process. In the conditioning, the material surfaces are treated in order to make the minerals thereafter more sharply and more economically to obtain the desired degree of concentration by means of flotation. Irrespective of preventive conditioning, a certain amount of slime always enters the flotation machine along with the feed, which slime for the major part is composed of mineral material of the colloid grain class and is present in all ore slurries ground to flotation fineness. Many ores contain one or several soft valuable minerals or gangue minerals, which tend to be ground to an extremely fine powder in the grinding stage. Owing to its large specific surface, the slime material is extremely active, tends to add to the consumption of reagents, forms slime coatings on top of all minerals and finally infiltrates pertinaciously even to the final concentrates, thus lowering their degree of concentration as well as causing other difficulties.

Several different methods have been applied for removing the slime, such as classification, where the finest ingredients are removed from the mineral material. However, the process of classification requires additional machinery, and the classification as such does not in any way affect the root cause of the phenomenon. Slime separation can also be improved by means of so-called selective flocculation, where the harmful, slime-creating mineral is attempted to be dispersed by means of certain reagents, whereas the rest of the minerals are simultaneously attempted to be brought into a strongly flocculized state.

Several different apparatuses have been developed for slime separation, such as centrifugal classifiers of one or several stages. Likewise, in the prior art there is developed the so-called Wheeler column cell, where slime separation is carried out by means of a froth bed and by washing the froth bed with water. Yet the height of the froth bed, compared to the slurry height of about 10 meters, is small. At the same time the height of the cell means that the bubbles are poorly mixed in the froth bed. Moreover, the washing is difficult to be arranged so that it would cover the major part of the froth bed.

The object of the present invention is to remove some of the drawbacks of the prior art and to achieve an improved flotation machine, particularly suited for slime separation, wherein the separation of the minerals is carried out in a froth bed. The invention is characterized by the novel features enlisted in the appended patent claims.

According to the invention, the slurry and froth space of the flotation machine is provided with at least one downwards narrowing, advantageously conical or wedge-shaped member, whereby the froth volume and the froth surface area can be regulated in order to form a thick froth bed. Inside the froth bed, there is further arranged a washing system for cleaning the concentrate.

In the flotation machine of the invention, the advantageous, essentially thick froth bed for the flotation machine is formed for instance by means of flotation oil or with some other corresponding agent. The height of the froth bed is between 20–40%, advantageously between 30–35% of the total height of the flotation cell, and the height of the froth bed is advantageously regulated by mens of at least one conical or wedge-shaped member provided inside the slurry and froth space, by moving the regulating member essentially in the vertical direction. Because the surface area of the froth bed decreases towards the top owing to the conical or wedge-shaped members provided in the froth bed, the washing system of the froth bed can advantageously be arranged so that the washing range is essentially extended throughout the whole area of the froth bed. Owing to the washing, the remaining small slime-forming particles on the surfaces of the froth bubbles, as well as other remaining impurities, can be removed, so that an improved content is obtained for instance for a repetition concentrate from a concentration circuit.

The washing system of a flotation machine according to the invention includes a pipework installed within the froth bed, wherefrom the washing liquid is sprayed out through nozzles placed at essentially regular intervals. On a same cross-sectional plane of the pipework there are advantageously provided two or more nozzles in order to direct the washing liquid to an essentially large area of the froth bed. Moreover, the spray nozzles of the washing liquid are advantageously designed so that an essentially high speed is obtained for the washing liquid shot through the nozzles, which in part improves the penetration of the washing liquid into the froth bed.

By means of the washing liquid, the slime-forming fine particles, as well as other impurities, are settled to the slurry tank of the flotation cell and are advantageously discharged through the slurry outlet provided in the bottom part of the cell. The employed washing liquid can be water, or some reagent or chemical which is advantageous in the washing process. Alternatively the washing liquid can also be a mixture of water and the reagent/chemical employed in the process.

Thus the use of the flotation machine of the invention improves, owing to the washing process, for instance the selectivity of finely ground ores with respect to small grain sized, and the thick froth bed helps in extending the time that the froth-forming bubbles remain within the cell.

BRIEF DESCRIPTION OF THE DRAWINGS

The invention is explained below in more detail with reference to the appended drawings, where.

Figure 1:
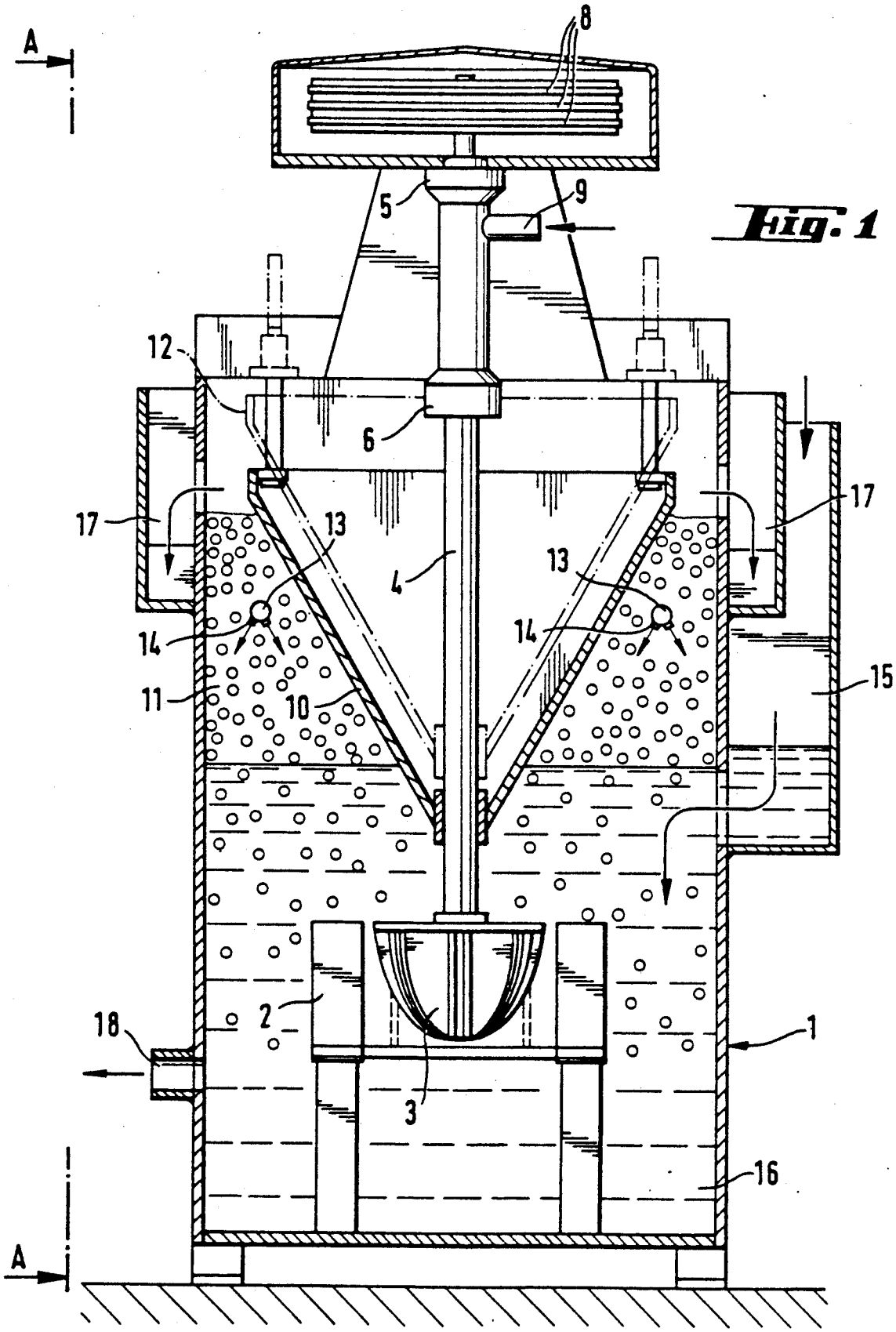
FIG. 1 is an illustration of a preferred embodiment of the invention, seen in a side-view cross-section.

According to FIG. 1, inside the flotation cell 1 there is placed the mixing mechanism comprising a stator 2 and a rotor 3. The rotor 3 is attached to a hollow axis 4, which is geared with bearings 5, 6 to the supporting structures of the cell. The electric motor 7 (FIG. 2) rotates the axis 4 by intermediation of the cone belts 8. Through the hollow axis 4, air is conducted into the rotor 3. The air inlet pipe is marked with the reference number 9.

According to the invention, around the axis 4 there is provided a conical member 10, whereby the volume and the surface area of the froth bed 11 around the member 10 can be regulated. At its top part, the regulating member 10 is supported against the supporting structures of the flotation cell, so that its position on the vertical plane parallel to the axis 4 can be adjusted. The dotted lines 12 illustrate an alternative position for the regulating member 10, in which case the free surface area of the froth bed has been multiplied by four in comparison with the previous position of the regulating member 10.

Figure 2:
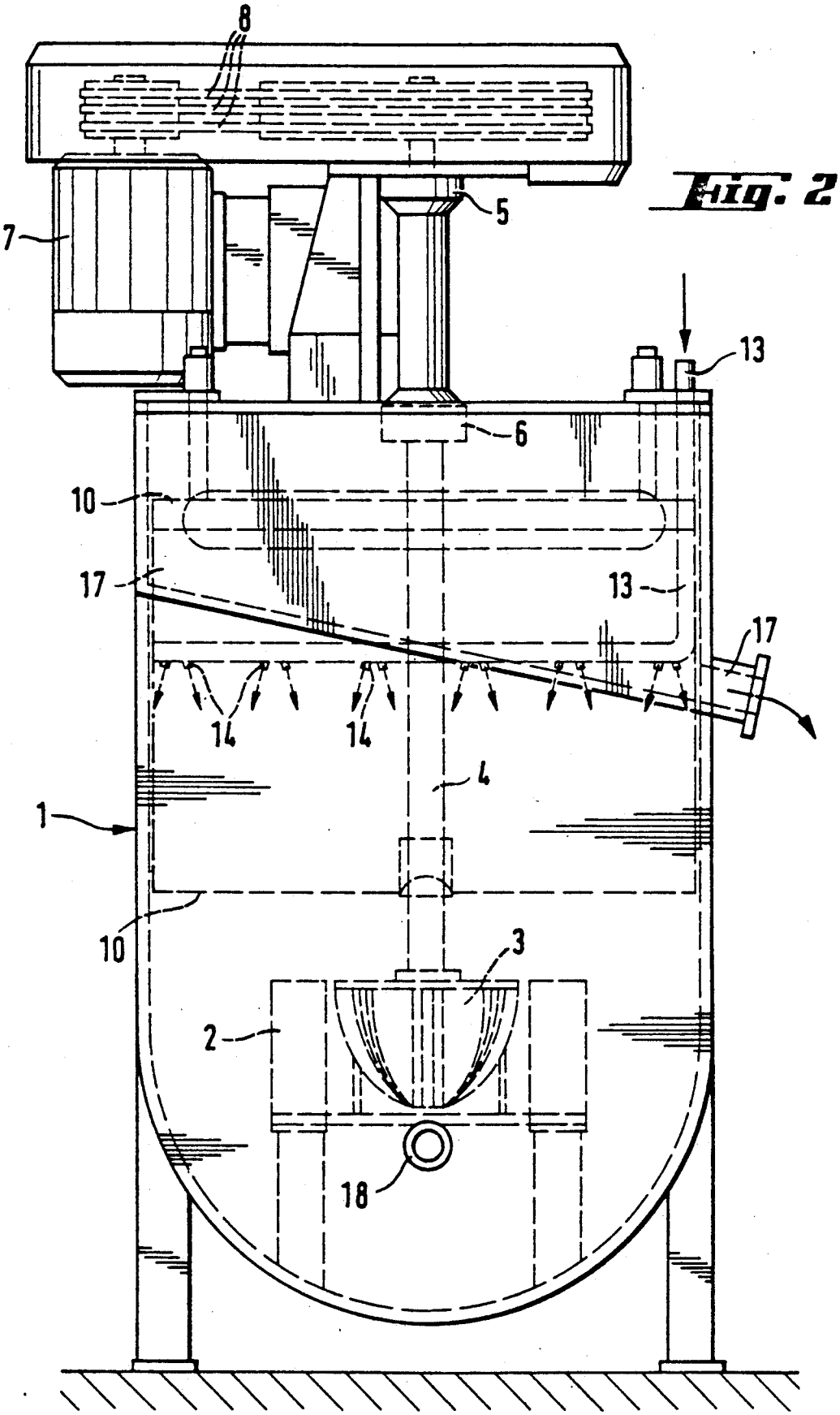
FIG. 2 is an illustration of the embodiment of FIG. 1, seen in the direction A—A.

The washing liquid used in the washing of the froth-forming bubbles is conducted into the flotation cell via the pipe 13 of FIG. 2, and the washing liquid is sprayed into the froth bed 11 via the nozzles 14 provided in the said pipe.

When the flotation cell is in operation, there is first formed the froth bed 11, the height, volume and free surface are whereof are adjusted to the desired measure by means of the regulating member 10. The feed of the cell is conducted, by means of the inlet pipe 15, to the slurry tank 16, wherefrom the desired valuable minerals, as well as the finely powdered slime, start to rise up, along with the bubbles created by means of the rotor/-stator combination, towards the froth bed 11. As a contrast the slurry accompanying the feed is settled towards the bottom of the cell. Because the available surface area of the froth bed is decreased owing to the conical regulating member 10, the bubbles present in the froth bed are pressed against each other while proceeding upwards, so that the delay time of single bubbles in the cell is increased, and the separating capacity of the froth is improved. The single bubbles are thus brought nearer to each other, and therefore the bubbles present in the froth can be washed with the washing liquid entering from the pipe 13 so that the washing effect is extended as wide as possible within the froth bed 11. By employing the washing liquid, the finely powdered slime material attached to the bubbles along with the valuable minerals is advantageously removed, as well as the other impurities, so that the valuable metal content in the concentrate obtained as an overflow 17 from the flotation cell can be increased. The material stuck in the washing liquid is discharged along with the washing liquid, as part of the flotation cell slurry through the slurry outlet 18 provided in the bottom part of the cell.

The above specification does not include a detailed description of the structures of the rotor and the stator, for example. This is due to the fact that the invention is not strictly limited to one certain rotor-stator type. Similarly for example the motor rotating the rotor can be installed to be operable from below the flotation cell, or it can even be installed inside the flotation cell.

In the above specification, the invention is explained with reference to one preferred embodiment only. It is naturally obvious that the invention can be largely modified within the scope of the appended patent claims.

We claim:

1. A flotation machine for removing mineral particles or the like from a slurry containing such particles, comprising:

wall means defining a flotation cell, a feed opening for introducing slurry into the cell and an overflow lip above the feed opening for discharging froth from the cell, a mixing mechanism comprising a stator and a rotor located inside the cell and beneath the feed opening, and actuator means for driving the rotor, air supply means for supplying air to the mixing mechanism and forming a froth bed in the flotation cell between the top of the feed opening and the overflow lip when slurry is present in the cell, a regulating means located in said cell for regulating the volume and/or surface area of the froth bed, which said regulating means comprises a regulating member that extends over at least the vertical range between the top of the feed opening and overflow lip and is shaped so that the horizontal sectional area of the volume defined between the regulating member and said wall means decreases in an upward direction over said vertical range, and wash means for supplying wash liquid for washing the froth bed, the wash means defining multiple nozzles within said vertical range.

2. Apparatus according to claim 1, wherein the vertical height between the top of the feed opening and the overflow lip is about 20–40% of the height of the flotation cell.

3. Apparatus according to claim 2, wherein the vertical height between the top of the feed opening and the overflow lip is 30–35% of the height of the flotation cell.

4. Apparatus according to claim 1, comprising means for vertically adjusting the location of the regulating member in the flotation cell.

5. Apparatus according to claim 1, wherein the regulating member is conical in shape.

6. Apparatus according to claim 1, wherein the regulating member is wedge-like in shape.

7. Apparatus according to claim 1, wherein the wash means comprise at least one elongate supply pipe extending within the flotation cell and formed with a plurality of nozzles spaced apart in the lengthwise direction of the supply pipe.

8. Apparatus according to claim 7, wherein the nozzles are spaced at essentially regular intervals from each other in the lengthwise direction of the supply pipe.

9. Apparatus according to claim 1, wherein the wash means are provided with at least two nozzles which are at substantially the same vertical height in the flotation cell.

10. Apparatus according to claim 1, wherein the regulating member is wedge-like in shape and the nozzles are positioned near the top of said vertical range.

11. A method of operating a flotation machine including a flotation cell having a feed opening for introducing slurry into the cell and an overflow lip for discharging froth from the cell, and also including a mixing mechanism comprising a stator and a rotor inside the cell, said method comprising:

introducing slurry into the cell, driving the rotor to rotate inside the cell and supplying air to the mixing mechanism, under conditions to form a froth bed in the flotation cell between the top of the feed opening and the discharge lip, bounding the volume occupied by the froth bed such that the horizontal sectional area of the froth bed decreases in an upward direction over the vertical range between the top of the feed opening and the overflow lip, and introducing wash liquid into the flotation cell for washing the froth bed, the wash liquid being introduced at a position inside the volume occupied by the froth bed.

12. A method according to claim 11, wherein the height of the froth bed is 24–40% of the height of the flotation cell.

13. A method according to claim 12, wherein the height of the froth bed is 30–35% of the height of the flotation cell.

14. A method according to claim 11, comprising discharging froth from the flotation cell through a discharge opening.

15. A method of operating a flotation machine including wall means defining a flotation cell having a feed opening for introducing slurry into the cell and an overflow lip above the feed opening for discharging froth from the cell, a mixing mechanism means located within a region beneath the feed opening for agitating slurry in said region, air supply means for supplying air to said region, and a regulating means located in said cell, said regulating means comprising a regulating member which extends over at least the vertical range between the top of the feed opening and the overflow lip and which is shaped so that the horizontal sectional area of the volume defined between the regulating member and the wall means decreases in an upward direction over the vertical range between the top of the feed opening and the overflow lip, said method comprising:

introducing slurry into the cell by way of the feed opening, agitating the slurry in the cell in said region beneath the feed opening and supplying air to said region beneath the feed opening, under conditions to form a froth bed in the flotation cell between the top of the feed opening and the overflow lip, and adjusting the vertical position of the regulating member in dependence upon the volume and/or surface area of the froth bed.

* * * * *